United States Patent [19]

Bell

[11] 4,238,801

[45] Dec. 9, 1980

[54] C-B ANTENNA EXTENDED SURFACE ATTACHMENT

[76] Inventor: Joseph P. Bell, Rte. 1, Box 2620, Grayslake, Ill. 60030

[21] Appl. No.: 35,820

[22] Filed: May 4, 1979

[51] Int. Cl.[3] ..... H01Q 1/32; H01Q 9/40

[52] U.S. Cl. ..... 343/715; 343/899

[58] Field of Search ..... 343/895, 899, 715, 908

[56] References Cited

U.S. PATENT DOCUMENTS

| | | | |
|---|---|---|---|
| 1,610,704 | 12/1926 | Paddack | 343/899 |
| 2,850,732 | 9/1958 | Kandoian et al. | 343/895 |
| 3,089,140 | 5/1963 | Monola | 343/752 |
| 3,656,170 | 4/1972 | Smith | 343/899 |
| 4,038,661 | 7/1977 | Nolte | 343/715 |

*Primary Examiner*—Eli Lieberman

*Attorney, Agent, or Firm*—Hill, Van Santen, Steadman, Chiara & Simpson

[57] ABSTRACT

A supplemental device for mounting on a rod-type antenna, particularly the antenna of a mobile C-B installation, for reducing the overall noise level in connection with the operation of the squelch control, utilizing a pair of assemblies each having at least one ring member and a plurality of cooperable radially extending rod members symmetrically arranged and intersecting the axis of the associated ring member, with such ring and rod members secured in rigid relation and lying substantially in a common plane, such assemblies being disposed in spaced parallel planes and rigidly connected substantially on their common axis by a cross member having means cooperable therewith for adjustably securing the device to an antenna, whereby it may be secured thereto at an optimum location therealong, with such antenna extending thereat in a plane parallel to said first mentioned planes.

10 Claims, 5 Drawing Figures

C-B ANTENNA EXTENDED SURFACE ATTACHMENT

BACKGROUND OF THE INVENTION

The invention is directed to a supplemental device that may be employed in connection with antennas, such as C-B antennas for improving the operation of the radio receiver associated therewith, particularly with respect to the noise level during operation.

Radios of the type involved employ what is known as a "squelch" control which reduces the sensitivity level below the noise level and thus renders the radio quiet, i.e. without interference noise, etc. Upon receipt of a signal, above the thereshold set by the circuit involved, the gain is increased. While the circuit is adjustable, to determine the desired threshold level, maximum sensitivity can be achieved only with accompanying noise and, depending upon the location, such noise level can be relatively very high. However, many users will set the threshold level at a relatively low point to utilize maximum sensitivity with the result that the noise level is very high, while such a setting, at the same time, may not result in a complete quieting or squelch operation.

The invention is directed to a device for effectively reducing such noise level, without material reduction, if any, in the sensitivity of the receiver.

SUMMARY OF THE INVENTION

The invention thus is directed to a device in the form of a supplemental structure which may be mounted on existing C-B antennas, as well new antennas, and which will provide a reduction in noise level, with no apparent loss in signal strength.

The present invention employs a structure which is mounted on the antenna and comprises a pair of assemblies, each having at least one ring member and a plurality of radially extending cross members. Each assembly has the ring and cross members thereof disposed in substantially a common plane and secured to one another to form a rigid assembly. The two assemblies are disposed in spaced relation, in respective parallel planes and are rigidly connected to one another by a cross member which also forms a part of the means for securing the device to an antenna structure.

In use, the device is mounted on the antenna, initially adjusting the same along the length of the antenna to manually determine the optimum location of the device along the length of the antenna. Once such optimum position is determined, the device may be rigidly secured to the antenna and left in such adjust position.

If desired, an additional supplemental member may be employed, which in the embodiment of the invention illustrated is in the form of a helical coil member, and which likewise may be positioned at an optimum point along the antenna length. In some cases such supplemental structure may be omitted.

BRIEF DESCRIPTION OF THE DRAWINGS

In the drawings wherein like reference characters indicate like or corresponding parts.

DETAILED DESCRIPTION OF THE INVENTION

Figure 1:
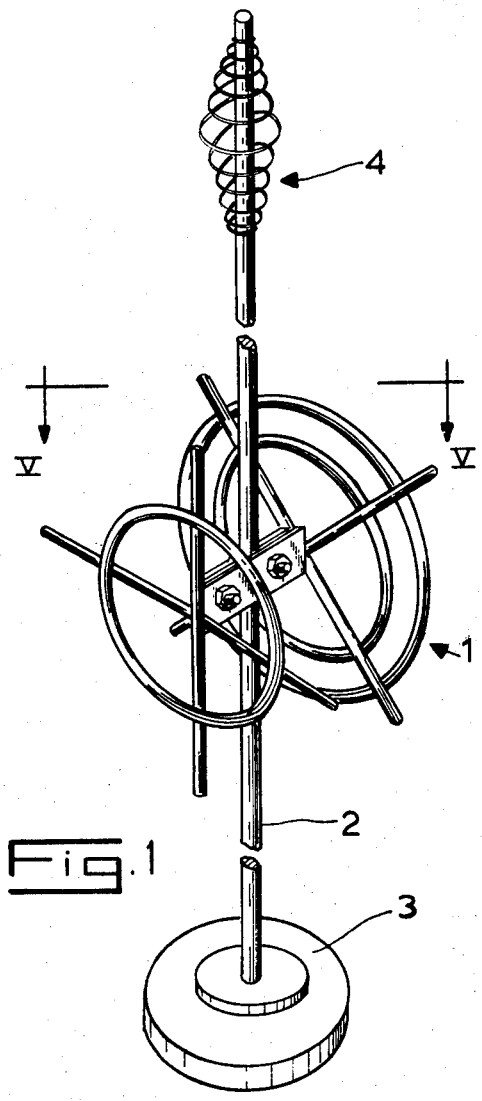
FIG. 1 is a perspective view of an antenna with a device, according to the invention, mounted thereon.

Referring to the drawings and particularly to FIG. 1, the reference numeral 1 indicates generally a device in accordance with the invention, mounted on a vertically extending rod or pole type antenna 2 supported from a base structure 3, which, for example, may be mounted on a vehicle in connection with a mobile radio installation.

In accordance with the invention, an additional device may be also mounted on the antenna, which in the embodiment illustrated comprises a helical soil member 4.

Figure 2:
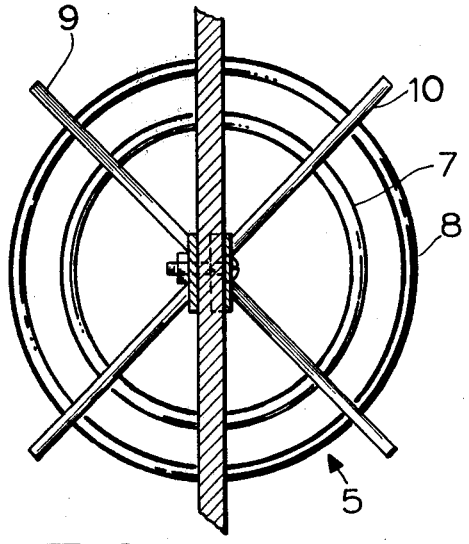
FIG. 2 is a sectional view taken approximately on the line II—II of FIG. 4.
Figure 3:
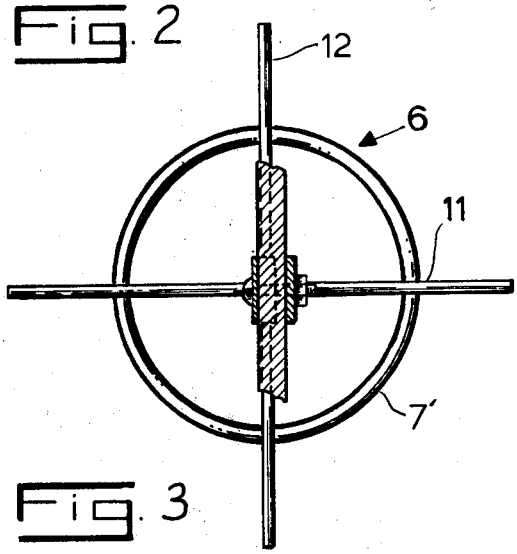
FIG. 3 is a sectional view taken approximately on the line III—III of FIG. 4.

As illustrated in FIGS. 2–5, the device 1 comprises two metal assemblies indicated generally be respective reference numerals 5 and 6, and, as illustrated in FIG. 2, the assembly 5 comprises a pair of ring members 7 and 8 of different sizes concentrically disposed in a common plane. The rings 7 and 8 are connected by respective rod members or elements 9 and 10 which, in the embodiment illustrated, are disposed at right angles to one another and intersect on the axis of the concentric rings and thus form four radially extending elements. As illustrated the members 9 and 10 have a length somewhat greater than the diameter of the larger ring member 8. The ring and rod members are rigidly secured to one another at their intersecting points by suitable welding or the like.

The assembly 6 is similarly constructed but employs merely a single ring member 7 which may, for example, have the same diameter as the ring 7. The rod members 11 and 12, corresponding to members 9 and 10, likewise intersect on the axis of the ring 7, with the respective ring and rod members being secured in rigid relation by welding or other suitable means, in the same manner as those of the assembly 5. In the embodiment illustrated, the rods 11 and 12 of the assembly 6 are of the same length as the rods 9 and 10 of the assembly 5.

Figure 4:
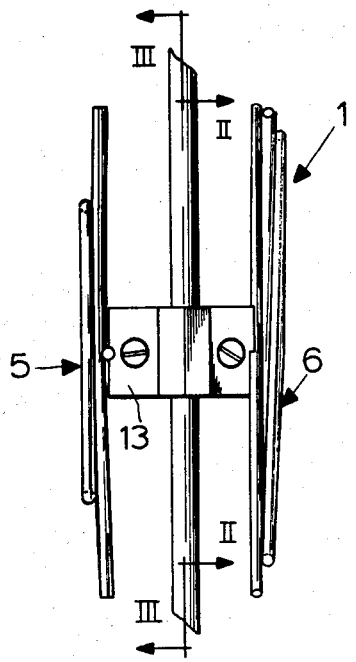
FIG. 4 is a side elevational view of the structure illustrated in FIGS. 2 and 3.
Figure 5:
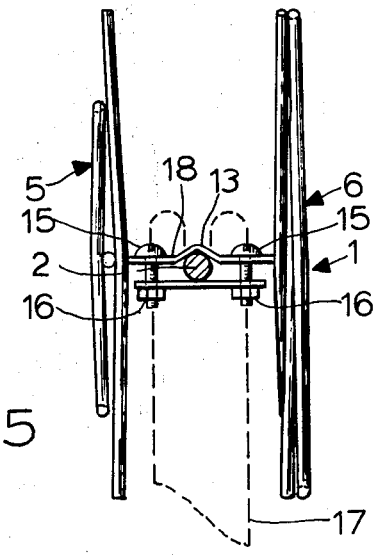
FIG. 5 is a top plan view of the structure illustrated in FIGS. 2–4.

As illustrated in FIGS. 4 and 5, the assemblies 5 and 6 are disposed in spaced parallel planes and connected in rigid relation by a metallic connecting a cross member 13, extending on the common axis of the ring members and secured at its ends to respective assemblies by welding to adjacent rod members of an assembly at their point of intersection. As clearly illustrated in FIGS. 4 and 5, suitably connected to the member 13 is a cooperable member or strip 14, the two members 13, 14 in the construction illustrated being connected to one another by means of screws 15 and cooperable nuts 16, whereby an intermediate portion of the antenna 2 may be clamped between the two members.

The device is adapted to be mounted on an antenna structure, such as the antenna 2, with the latter being disposed at such mounting in a plane which is parallel to and substantially centered between the planes of the assemblies 5 and 6. To facilitate such orientation of the atenna, one of the members 13, 14 may be provided with a semi-cylindrical or V-shaped bend 16 therein, illustrated as being formed in the member 13, and which extends more or less concentric with the axis of the antenna 2 and thus parallel to the planes of the two assemblies.

In use, the device is loosely mounted on the antenna as illustrated in FIGS. 1, 4 and 5, and with the radio receiver turned on, the device is munually moved along the axis of the antenna. When an optimum location has been reached at which the background noise will be materially reduced, the screws and nuts 15–16 may be tightened down to firmly secure the device on the antenna.

In addition to the structure 1, an additional supplementary device may be utilized, which in the embodiment of the invention illustrated may comprise a generally helically coiled member 4, which is so constructed that the ends of the member 4 may be frictionally engaged with an antenna passing therethrough to firmly support the structure at a desired location on the antenna. As in the case of the device 1, following optimum adjustment of the latter on the antenna, the member 4 is similarly moved along the length of the antenna to an optimum position for improved reception.

In some cases, the additional supplemental member offers insufficient improvement sufficient to warrant its use, while in others it aids materially in achieving the desired results.

To facilitate the adjustment of the devices 4 and 1 on the antenna, a suitable adjusting member or tool 17 may be provided, for example as illustrated in FIG. 5, which may be formed from a suitably rigid strip of plastic or other material having suitable dielectric properties, and provided with a bifurcated end as indicated at 18 whereby the bifurcated end portions of the member may be disposed on opposite sides of the antenna 2 and engage the members 13, 14 by means of which the device may be shifted along the axis of the antenna. The use of such a member enables the achievement of satisfactory adjustment of the member without any interference from body capacity of the installer, etc.

The member 4 may likewise be adjusted in a similar manner with the tool 17.

Although I have described my invention by reference to particular illustrative embodiments, many changes and modifications of in invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. A supplemental device for mounted on a rod-type antenna, particularly the antenna of a mobile C-B installation, for reducing the overall noise level in connection with the operation of the squelch control thereof, comprising a pair of assemblies, each having at least one ring member and a plurality of cooperable rod members symmetrically arranged and physically intersecting each other and the axis of the associated ring member, said ring and rod members of each pair being secured in rigid relation with the members thereof lying substantially in a common plane, forming a unitary assembly, said assemblies being disposed on a common axis in spaced parallel planes, a cross member rigidly connecting said assemblies at the intersection of the respective rod members thereof, and means cooperable with said cross member for securing said assemblies to an antenna, with the latter extending therebetween in a plane substantially centered between said first-mentioned planes.

2. A device according to claim 1, wherein two rod members are employed in each assembly, which extend at right angles to one another.

3. A device according to claim 1, comprising in further combination, a second ring member, forming a part of one of said assemblies and disposed in the plane thereof in concentric relation relative to the other ring of such assembly.

4. A device according to claim 3, wherein two rod members are employed in each assembly, which extend at right angles to one another

5. A device according to claim 3, wherein both assemblies have a ring member of like diameter, and the second ring of the one assembly is of a greater diameter than that of the other ring member thereof.

6. A device according to claim 5, wherein two rod members are employed in each assembly, which extend at right angles to one another.

7. A device according to claim 6, comprising in further combination, a helically coiled member adapted to be secured to such an antenna structure, intermediate the free end of the latter and said assemblies.

8. A device according to claim 7, wherein said helically coiled member is of elongated configuration, with the coils at each end thereof being smaller in diameter than at an intermediate portion thereof.

9. A device according to claim 1, comprising in further combination, a helically coiled member adapted to be secured to such an antenna structure, intermediate and free end of the latter and said assemblies.

10. A device according to claim 9, wherein said helically coiled member is of elongated configuration, with the coils at each end thereof being smaller in diameter than at an intermediate portion thereof.

* * * * *